US006431656B1

(12) United States Patent
Kammerer

(10) Patent No.: US 6,431,656 B1
(45) Date of Patent: Aug. 13, 2002

(54) PROCESSING TOOL FOR A ROAD SURFACE PROCESSING MACHINE

(75) Inventor: Karl Kammerer, Fluorn-Winzeln (DE)

(73) Assignee: Betek Bergbau-und Hartmetalltechnik Karl-Heinz Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 09/570,637

(22) Filed: May 15, 2000

(30) Foreign Application Priority Data

May 14, 1999 (DE) ..... 199 22 318

(51) Int. Cl.[7] ..... E01C 23/16

(52) U.S. Cl. ..... 299/79.1; 299/85.2; 299/37.3; 299/25; 404/94

(58) Field of Search ..... 451/350, 352; 172/45; 37/244, 246; 299/25, 24, 37.3, 39.9, 39.8, 79.1, 85.2, 95, 39.7; 241/193; 404/94, 93

(56) References Cited

U.S. PATENT DOCUMENTS 56,108 A * 7/1866 Shaw ..... 241/193
2,606,011 A * 8/1952 Lommen ..... 299/39.7
5,944,268 A * 8/1999 Andela ..... 241/99

FOREIGN PATENT DOCUMENTS

DE 37 01 905 C1 9/1988

* cited by examiner

*Primary Examiner*—David Bagnell
*Assistant Examiner*—John Kreck
(74) *Attorney, Agent, or Firm*—Pauley Petersen Kinne & Erickson

(57) ABSTRACT

A processing tool for a road surface processing machine, having a tool head coupled with a support element, wherein the support element can be exchangeably fastened on a tool holder. For increasing the non-skid properties of the road surface, the tool head is coupled by a suspension with the support element, by which the tool head can be adjusted relative to the support element.

12 Claims, 1 Drawing Sheet

PROCESSING TOOL FOR A ROAD SURFACE PROCESSING MACHINE

BACKGROUND OF THE INVENTION

Field of the Invention

This invention relates to a processing tool for a road surface processing machine, having a tool head coupled with a support element, wherein the support element can be exchangeably fastened on a tool holder.

Description of Related Art

Such a processing tool is known from German Letters Patent 37 01 905.8-09. This known processing tool is also called a shaft cutter. It has a cutter shaft which can be exchangeably inserted into a cutter receiver of a cutter holder. A tool head is formed on the cutter shaft. The tool head is equipped with a hard alloy tip. In operation, the hard alloy tip engages with the road surface and cuts off the road surface, which is required when heavy wear conditions become apparent. But it can also occur that, although no heavy wear conditions are present, a non-skid effect of the road surface is more and more reduced because of the wear caused by tires. This occurs mainly in connection with concrete surfaces wherein cutting the road surface would be inexpedient and inefficient.

SUMMARY OF THE INVENTION

It is one object of this invention to provide a processing tool of the type initially mentioned, by which the non-skid properties of a road surface can be efficiently increased.

This object is attained with a tool head coupled by a suspension with the support element, by which it can be adjusted relative to the support element.

When the tool head impacts on the road surface, shifting or shattering of sections of the road surface occurs, without removing large masses of the road surface in the process. This is the result of the tool head yielding with respect to the road surface because of its resilient suspension. This change in the geometry of the road surface alone is sufficient to cause a noticeable improvement in the non-skid properties of the road surface.

In accordance with one preferred embodiment of this invention, the support element has an intermediate piece, which extends between a fastening point of the suspension on the tool head and a fastening point of the suspension on the support element. The intermediate piece has a fixed length between the two fastening points. The tool head can be deflected, at least in the direction of the tool feed, with respect to the support element.

A processing tool, which can be cost-effectively manufactured can, for example, be of such a nature, that the suspension has an element of low flexural strength.

The low flexural strength element of the suspension can be a wire cable. The wire cable end is soldered into the tool head, made of a hard alloy.

In accordance with another preferred embodiment of this invention, the processing tool can be of such that the suspension has a joint, and the tool head is coupled to one of the two joint elements of the joint by a lever.

If the support element has a round shaft, which is seated in a receiver of the tool holder and is rotatable around an axis of rotation extending in a longitudinal direction of the round shaft, then the tool head wears evenly around its circumference because of its rotation.

Thus, for a dependable fixation in place of the processing tool the round shaft is enclosed at least partially by a clamping sleeve. The clamping sleeve has at least one holding element which projects in a direction toward the round shaft and engages a groove of the round shaft extending around the axis of rotation. The exterior circumference of the clamping sleeve is clampingly held on the interior circumference of the receiver of the tool holder.

BRIEF DESCRIPTION OF THE DRAWINGS

This invention will be explained in greater detail in what follows by exemplary embodiments represented in the drawing, wherein.

DESCRIPTION OF PREFERRED EMBODIMENTS

Figure 1:
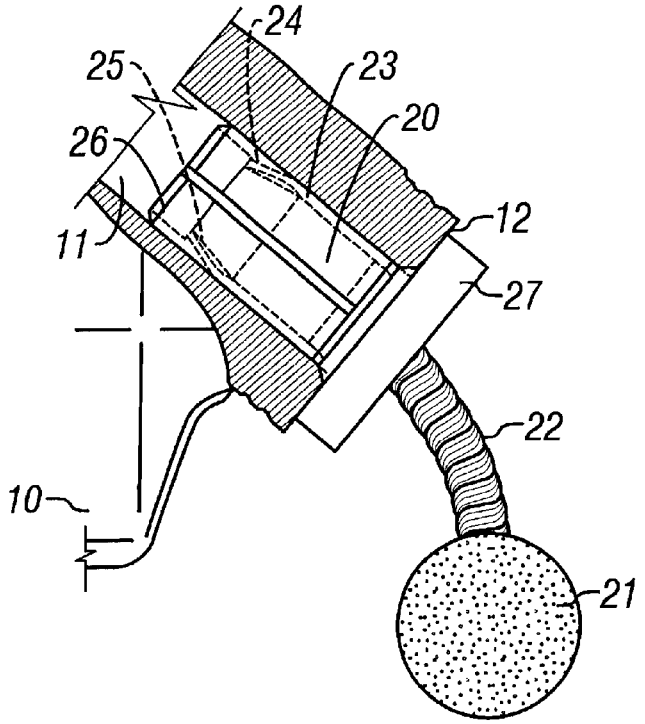
FIG. 1 shows a partial sectional side view of a tool holder with a processing tool.

A tool holder 10, which has a receiver 11 in the form of a cylindrical bore, is shown in FIG. 1. The bore inlet of the receiver 11 transitions into a ringshaped support surface 12, which extends perpendicularly relative to the center longitudinal axis of the receiver 11. A support element 27 of a processing tool is supported on the support surface 12.

The support element 27 is disk-shaped and protects the support surface 12, and therefore the tool holder 10 against mechanical effects.

A cylindrical round shaft 20 is formed on the support element 27. A groove 25 is cut into an area of the round shaft 20 facing away from the support element 27. The groove 25 is delimited by a collar 26 on an end of the round shaft 20. A clamping sleeve 23 is pulled on the round shaft 20. Except for a longitudinal slit, the clamping sleeve 23 completely encloses the round shaft 20. The clamping sleeve 23 has several punched-out holding elements 24 which project toward the round shaft 20 and enter the groove 25. The holding elements 24 hold the round shaft 20 captively in the axial direction, however, permit the round shaft 20 to rotate in the circumferential direction. The exterior circumference of the clamping sleeve 23 is spring-elastically clamped on the interior circumference of the receiver 11.

On a side facing away from the round shaft 20, the support element 27 maintains a suspension 22. The suspension 22 is embodied as a low flexural strength element, for example as a wire cable. A tool head 21, made of a hard alloy, a sintered material, a chilled casting material, or any other hard material, is soldered to the free end of the wire cable. The wire cable sets a fixed length between the connecting points on the support element 27 and the tool head 21.

During operation of the tool, the tool holder 10, which is fastened on a cylinder-shaped cutting body, rotates around an axis of rotation. The tool head 21 is located at a distance from the support element 27, wherein the suspension is oriented in the direction of the center longitudinal axis of the round shaft 20 because of centrifugal forces acting on it.

When the tool head 21 impacts on a road surface to be processed, it is deflected because of the suspension 22 of low flexural strength. This means that the tool head transfers its kinetic energy to the road surface in the form of impact power. The tool interaction with the road surface results in a depression, or respectively shattering, of the latter. The non-skid effect of the road surface is thus increased.

Figure 2:
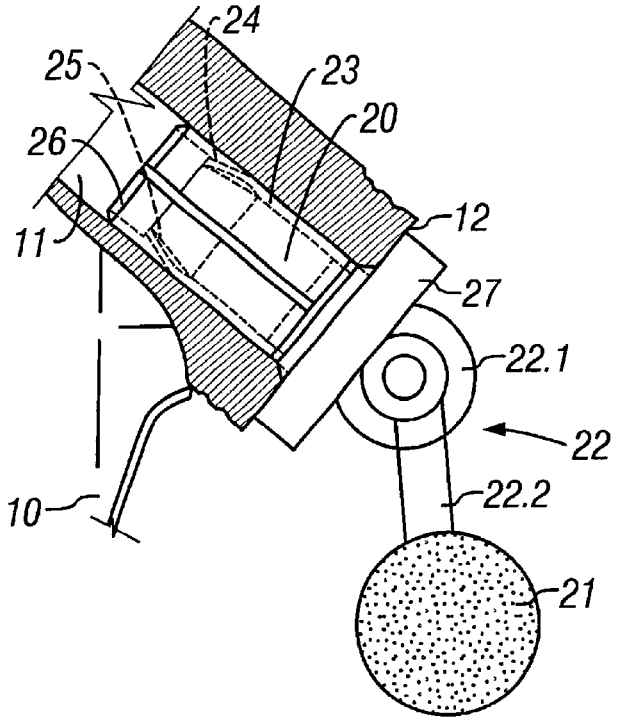
FIG. 2 shows a partial sectional side view of the tool holder in accordance with FIG. 1 but in an alternative embodiment.

A further embodiment of this invention is shown in FIG. 2. The structural design of this processing tool is essentially similar to the processing tool in accordance with FIG. 1. However, in the embodiment of FIG. 2, the tool head is coupled to a joint 22.1, designed as a universal joint, via a rigid lever 22.2. The universal joint is fastened on the support element 27 and makes deflection of the tool head possible upon impact with the road surface.

What is claimed is:

1. In a processing element for a road surface processing machine, having a tool head coupled with a support element, wherein the support element can be exchangeably fastened on a tool holder, the improvement comprising:

the tool head coupled by a suspension (22) with the support element (27), by which the tool head is freely movable relative to the support element (27), and the support element (27) having a round shaft (20) seated in a receiver (11) of a tool holder (10) and rotatable around an axis of rotation extending in a longitudinal direction of the round shaft (20).

2. The processing element in accordance with claim 1, wherein the suspension extends between a first fastening point of the suspension (22) on the tool head (21) and a second fastening point of the suspension (22) on the support element (27), the suspension (22) has a fixed length between the two fastening points, and the tool head (21) is deflectable with respect to the support element (27).

3. The processing element in accordance with claim 2, wherein the suspension (22) has an element of low flexural strength.

4. The processing element in accordance with claim 3, wherein the low flexural strength element is a wire cable.

5. The processing element in accordance with claim 4, wherein the wire cable end is soldered into the tool head (21) which is made of a hard alloy.

6. The processing element in accordance with claim 2, wherein the suspension (22) has a joint (22.1), and the tool head (21) is coupled to one of two joint elements of the joint (22.1) by a lever (22.2).

7. The processing element in accordance with claim 6, wherein the round shaft (20) is enclosed at least partially by a clamping sleeve (23), the clamping sleeve (23) has at least one holding element (24) which projects toward the round shaft (20) and enters into a groove (25) of the round shaft (20) extending around the axis of rotation, and an exterior circumference of the clamping sleeve (23) is clampingly held on an interior circumference of the receiver (11) of the tool holder (10).

8. The processing element in accordance with claim 1, wherein the suspension (22) has an element of low flexural strength.

9. The processing element in accordance with claim 8, wherein the low flexural strength element is a wire cable.

10. The processing element in accordance with claim 9, wherein the wire cable end is soldered into the tool head (21) which is made of a hard alloy.

11. The processing element in accordance with claim 1, wherein the suspension (22) has a joint (22.1), and the tool head (21) is coupled to one of two joint elements of the joint (22.1) by a lever (22.2).

12. The processing element in accordance with claim 1, wherein the round shaft (20) is enclosed at least partially by a clamping sleeve (23), the clamping sleeve (23) has at least one holding element (24) which projects toward the round shaft (20) and enters into a groove (25) of the round shaft (20) extending around the axis of rotation, and an exterior circumference of the clamping sleeve (23) is clampingly held on an interior circumference of the receiver (11) of the tool holder (10).

* * * * *